US007759638B2

(12) United States Patent
Makarov

(10) Patent No.: US 7,759,638 B2
(45) Date of Patent: Jul. 20, 2010

(54) MASS SPECTROMETER

(75) Inventor: Alexander Alekseevich Makarov, Cheshire (GB)

(73) Assignee: Thermo Finnigan LLC, San Jose, CA (US)

( * ) Notice: Subject to any disclaimer, the term of this patent is extended or adjusted under 35 U.S.C. 154(b) by 303 days.

(21) Appl. No.: 11/909,855

(22) PCT Filed: Mar. 29, 2006

(86) PCT No.: PCT/GB2006/001174

§ 371 (c)(1),
(2), (4) Date: Sep. 27, 2007

(87) PCT Pub. No.: WO2006/103448

PCT Pub. Date: Oct. 5, 2006

(65) Prior Publication Data

US 2008/0224033 A1 Sep. 18, 2008

(30) Foreign Application Priority Data

Mar. 29, 2005 (GB) ..... 0506288.0
May 31, 2005 (GB) ..... 0511079.6

(51) Int. Cl.
*H01J 49/40* (2006.01)

(52) U.S. Cl. ..... 250/287; 250/281; 250/282

(58) Field of Classification Search ..... 250/287, 250/288, 290, 292, 281, 282
See application file for complete search history.

(56) References Cited

U.S. PATENT DOCUMENTS

| | | | | |
|---|---|---|---|---|
| 5,825,026 | A * | 10/1998 | Baykut | 250/288 |
| 7,309,860 | B2 * | 12/2007 | Baba et al. | 250/288 |
| 7,399,962 | B2 * | 7/2008 | Makarov | 250/294 |
| 2004/0217272 | A1 | 11/2004 | Horning et al. | |

FOREIGN PATENT DOCUMENTS

| | | | |
|---|---|---|---|
| GB | 2300967 | A | 11/1996 |
| GB | 2394356 | A | 4/2004 |
| GB | 2395061 | A | 5/2004 |
| JP | 11-144675 | | 5/1999 |
| JP | 2004-158360 | | 6/2004 |
| WO | WO 97/48120 | | 12/1997 |
| WO | WO 01/78106 | A2 | 10/2001 |
| WO | WO 02/48699 | | 6/2002 |

* cited by examiner

*Primary Examiner*—Kiet T Nguyen
(74) *Attorney, Agent, or Firm*—Charles B. Katz

(57) ABSTRACT

This invention relates to mass spectrometers comprising a reaction cell and where mass spectra are collected both from unreacted ions and also from reaction product ions. In particular, although not exclusively, this invention finds use in tandem mass spectrometry where mass spectra are collected from precursor and fragment ions. The present invention provides an arrangement where ions may be sent to a reaction cell for fragmentation or other processing before onward transport to a mass analyser. Alternatively, ions may be passed directly to a mass analyser along a bypass path.

27 Claims, 3 Drawing Sheets

MASS SPECTROMETER

FIELD OF THE INVENTION

This invention relates to mass spectrometers comprising a reaction cell and where mass spectra are collected both from unreacted ions and also from reaction product ions. In particular, although not exclusively, this invention finds use in tandem mass spectrometry where mass spectra are collected from precursor and fragment ions.

BACKGROUND OF THE INVENTION

Mass spectrometers typically comprise an ion source where an analyte is ionised and extracted to pass to a mass analyser. Ion optics controls the passage of ions through the mass spectrometer. The ion path between ion source and mass analyser may include one or more ion traps/ion stores, and may also include a further mass analyser. Such a further mass analyser is often used for the rapid acquisition of pre-scans (i.e. low resolution mass spectra used for initial identification of ions). The other mass analyser tends to be of a higher resolution.

In its broadest sense, this invention relates to mass spectrometry that makes selective use of a reaction cell to alter a population of ions to be analysed. The "reaction" may be any act that changes the ion population such as mass filtering, introducing other ions, fragmenting ions, causing the ions to react to form new molecular species, or changing the energy or charge state of the ions to name but a few examples. Of course, combinations of the above may also be performed in the reaction cell. Often, it is desirable to collect mass spectra from both the unreacted ions and the product ions. This allows difference spectra to be derived such that product ions are easily identified.

In traditional tandem mass spectrometers, the reaction cell also resides on the ion path between ion source and high-resolution mass analyser. As a result, all ions must pass through the reaction cell to reach the high-resolution mass spectrometer. If a mass spectrum from the precursor ions is required, the reaction cell must be inactivated. Often, a mass spectrometer will be continually switched between acquisition of mass spectra from precursor and product ions such that operation of the reaction cell must also be switched continually between reacting and non-reacting. At best, this introduces a time delay and ion losses; at worst (e.g. for reactions with reactive gas), such switching is impossible on the time scale of analysis.

To provide a specific context for this invention, there follows a brief discussion of tandem mass spectrometry. Tandem mass spectrometry comprises the fragmentation of precursor ions in a reaction cell. Fragmentation may be effected in a number of ways, e.g. electron capture dissociation (ECD), collision induced dissociation (CID), photon induced dissociation (PID), surface induced dissociation (SID), electron transfer dissociation (ETD), etc. In tandem mass spectrometry, in the narrow meaning of this term, there is only one stage of fragmentation so that spectra are taken from precursor and first-generation fragment ions. However, further stages of fragmentation may be performed such that the fragment ions may themselves be fragmented. This is referred to as $MS^n$ spectrometry, with n referring to the level of selection such that tandem mass spectrometry corresponds to $MS^2$.

Typical tandem mass spectrometers are disclosed in papers like Hunt D F, Buko A M, Ballard J M, Shabanowitz J, and Giordani A B; Biomedical Mass Spectrometry, 8 (9) (1981) 397-408 (both precursor and fragments are selected by quadrupoles); H. R. Morris, T. Paxton, A. Dell, J. Langhorne, M. Berg, R. S. Bordoli, J. Hoyes and R. H. Bateman; Rapid Comm. in Mass Spectrom; 10 (1996) 889-896 and numerous patents such as U.S. Pat. No. 6,285,027B1 (wherein precursors are selected by a quadrupole and fragments are analysed using time-of-flight (TOF) analyser). Each of these mass spectrometers has a fragmentation cell disposed on the ion path between ion source and mass analyser. Therefore, the reaction cell must be made inactive when mass spectra are required from the precursor ions. In CID, this necessitates evacuating the collision gas from the fragmentation cell which is a time-consuming process.

Higher throughput of fragmentation is provided in US 2002/115,056, US 2002/119,490 and US 2002/168,682, wherein ion fragmentation is performed for all precursors in parallel and specificity is sacrificed in favour of speed.

U.S. Pat. No. 6,586,727 proposes a compromise where, for collection of spectra from fragment ions, the reaction cell is operated to favour fragmentation and, for collection of spectra from precursor ions, the reaction cell is operated to reduce fragmentation. The spectra taken from precursor and fragment ions respectively are searched for fragment ions of interest or for precursor/fragment peak pairs separated by a predetermined neutral loss. Identified pairs may be chosen for subsequent tandem mass spectrometry. For reliable identification, m/z for both precursor and fragment mass peaks must be determined with accuracy of several parts per million. Therefore such parallel-processing methods require the use of accurate-mass analysers such as FT ICR, single- or multiple-reflection TOFs, orbitrap, etc., all of which operate in a substantially pulsed manner. However, the continuous ion beam that exits the reaction cell in U.S. Pat. No. 6,586,727 is sampled by an orthogonal acceleration TOF analyser with quite low transmission and duty cycle, so sensitivity of the method gets compromised. Also, the layout of the mass spectrometer precludes it from acquiring precursor spectra while fragmentation is carried out (which could be very advantageous for relatively slow fragmentation methods such as ETD, ECD, IRMPD). Generally linear geometry of such instruments makes installation of such novel methods quite difficult and prone to compromising analytical performance.

WO97/48120 describes a tandem mass spectrometer that uses a time of flight (TOF) mass analyser. A reaction cell is provided, unusually located beyond the TOF analyser. Precursor ions are generated by an ion source, kicked sideways into the TOF analyser to be reflected by an ion mirror. Where a mass spectrum of the precursor ions is required, the ion mirror is operated to reflect the precursor ions to be incident on the detecting element of the TOF analyser. Where fragment ions are of interest, the ion mirror is operated to reflect ions to miss the detecting element and instead exit the TOF analyser and enter a reaction cell where they are fragmented. The fragment ions are ejected from the reaction cell back into the TOF analyser where the ion mirror is operated to reflect the fragment ions to be incident on the detecting element. Although this geometry offers greater flexibility in the design and operation of the reaction cell, its utility is limited because of high ion losses caused by the low duty cycle of orthogonal pulsing.

The above mass spectrometers suffer from a number of problems, in addition to the problem of switching between fragmenting/non-fragmenting modes already described. Spectra are acquired from all fragment ions at the same time. Consequently, the fragment spectra become very crowded and this limits the number of precursor/fragment pairs that will be found. In addition, this also adversely affects the dynamic range of ion intensities that may be addressed in the search (i.e. low-intensity precursor peaks might go unnoticed).

SUMMARY

The objective of this invention is to avoid limitations of the above mass spectrometers by 1) physically separating ion paths through the mass spectrometer followed by ions to be fragmented and ions not to be fragmented, as well as by 2) using a common unit for subsequent pulsed injection of fragmented or non-fragmented ions into an accurate-mass analyser.

Against this background and from a first aspect, the present invention resides in a mass spectrometer comprising: an ion source, a reaction cell and a mass analyser; the mass spectrometer defining a main ion path and a branch ion path, wherein the main ion path extends between the ion source and the mass analyser, and the main ion path meets the branch ion path at a junction comprising ion optics operable to guide selectively ions travelling downstream from the ion source along either the main ion path or the branch ion path, the branch ion path rejoining the main ion path upstream of the mass analyser either at the junction or at a further junction comprising further ion optics operable to guide ions towards the mass analyser that are incident from both the main ion path and the branch ion path, wherein the reaction cell is positioned on a separated portion of the branch ion path and wherein the ion optics immediately upstream of the mass analyser are operable to guide pulses of ions along the main ion path to the mass analyser.

Locating the reaction cell on a branch ion path, as opposed to the main ion path to the analyser, means that the reaction cell may be bypassed when a mass spectrum is to be collected from precursor ions. As a result, the reaction cell need not be switched on and off repeatedly: the reaction cell may be switched on at all times and the ion optics at the junction merely switched between guiding the ions to the reaction cell or direct to the mass analyser as pulses of ions. Generally, the speed of switching the ion optics will be more rapid than the speed of switching the reaction cell on and off (especially when reaction gases or hot cathode are present). For gas-filled cells, there is also a saving in ion transit times (typically a few to a few tens of milliseconds).

For relatively slow fragmentation methods (such as ETD, ECD, IRMPD), it would be advantageous to enclose ions in the branch path and meanwhile use the main path for mass analysis of precursors.

It will be appreciated that "main" ion path and "branch" ion path are but merely relative terms and no special importance need be attached to the term "main". As such, the main ion path may in fact be shorter or contain less components than the branch ion path.

Advantageously, the ion optics immediately upstream of the mass analyser may be operable to prepare the ions for ejection to the mass analyser as a pulse of ions. Generally, the duration of a pulse for ions of the same m/z should be well below 1 ms, and preferably below 10 microseconds. A most preferred regime corresponds to ion pulses shorter than 0.5 microsecond (this may be used for m/z roughly between 400 and 2000). Alternatively, and particularly for pulses of ions with a spread of m/z, spatial length of the emitted pulse should be less than 1 m, and preferably below 50 mm. A most preferred regime corresponds to ion pulses around 5-10 mm or even shorter. The most preferable regime is especially beneficial for electrostatic type mass analysers like the Orbitrap analyser and multi-reflection TOF analysers.

The reaction cell may be located at the end of the branch ion path. With this arrangement, the reaction cell may be operable to receive ions from the branch ion path, to process the ions and to allow the product ions to exit back along the branch ion path in an upstream direction to rejoin the main ion path at the junction. Upon reaching the junction once more, the ion optics at the junction are operable to guide ions along the main ion path downstream to the mass analyser.

Alternatively, the reaction cell may be located part way along a branch ion path that rejoins the main ion path at a second junction. The second junction may have ion optics operable to guide ions towards the mass analyser that are incident from both the main ion path and the branch ion path. With this arrangement, the reaction cell is operable to receive ions from the branch ion path, to process the ions and to allow the product ions to exit along a continuation of the branch ion path in a downstream direction to the further junction.

In all cases, the junction immediately before the mass analyser could provide ion storage and subsequent pulsing of stored ions into the mass analyser.

From a second aspect, the present invention resides in a mass spectrometer having a longitudinal axis, comprising: an ion source to direct ions along said axis; a reaction cell having an entrance aperture located on said axis; a mass analyser; and ion optics switchable between a first mode in which ions from the ion source are guided along said axis to said reaction cell and product ions produced in the reaction cell are guided to the mass analyser for analysis, and a second mode in which ions from the ion source are deflected from said axis and guided to the mass analyser for analysis without entering the reaction cell.

Preferably, the mass analyser resides on a main ion path linking the ion source and the mass analyser, and the reaction cell resides on a branch ion path that meets the main ion path at a junction having ion optics operable to guide selectively ions along either the main ion path or the branch ion path, wherein the branch ion path and the portion of the main ion path upstream of the junction extend along the longitudinal axis.

From a third aspect, the present invention resides in a mass spectrometer having a longitudinal axis, comprising: an ion source to direct ions along said axis; a reaction cell; a mass analyser having an entrance aperture located on said axis; and ion optics switchable between a first mode in which ions from the ion source are deflected from said axis and guided to the reaction cell and product ions produced in the reaction cell are guided back to said axis and to said entrance aperture of the mass analyser, and a second mode in which ions from the ion source are guided along said axis to the mass analyser for analysis without entering the reaction cell.

Preferably, the mass analyser resides on a main ion path corresponding to the longitudinal axis, and the reaction cell resides on a separated branch ion path that meets the main ion path at a junction having ion optics operable to guide selectively ions along either the main ion path or the branch ion path.

Optionally, the mass spectrometer according to the second and third aspects may be arranged to provide the ions to the mass analyser as a pulse of ions.

Optionally, the mass spectrometer may further comprise an ion trap located at the junction and/or any further junction, thereby allowing trapping of ions prior to ejection either to continue along the main ion path or to follow the branch ion path. In a currently preferred embodiment, the ion trap is a curved linear trap. Ions may be ejected axially to the reaction cell and orthogonally to the mass analyser. Advantageously, the orthogonal ejection may take advantage of the curvature of the ion trap to focus the ions.

Optionally, the reaction cell may be any one of the following: a gas-filled collision cell for collision-induced dissociation, a cell provided with an ion source for the introduction of further ions (e.g. for ETD or charge reduction), a cell provided with a laser source for photon-induced association, a cell provided with a surface for surface-induced dissociation, a cell provided with an electric source for electron-capture dissociation, a DC or field-asymmetric ion mobility spectrometer to act as an ion instability or charge filter, or any combination of the above.

The mass spectrometer may further comprise a controller operable to control operation of the mass spectrometer according to first and second modes. The first mode comprises causing the ion source to generate ions, causing ion optics to guide ions to the junction, causing the ion optics of the junction to guide ions to the reaction cell, causing the reaction cell to process the ions to form product ions, causing ion optics to guide the product ions to the mass analyser, and causing the mass analyser to acquire at least one mass spectrum from the product ions. The second mode comprises causing the ion source to generate ions, causing ion optics to guide ions to the junction, causing the ion optics of the junction to guide ions to the mass analyser, and causing the mass analyser to acquire at least one mass spectrum from the product ions.

It is important to note that both modes could run concurrently. For example, while a first set of ions is processed in the reaction cell, a second set of ions could flow without any impediment towards the mass analyser to produce product mass spectra.

Optionally, the mass spectrometer may further comprise a filter operable to filter product ions produced by the reaction cell. The filter may be operable to filter ions on the basis of mass or energy (or effectively both where there is a close relationship between the mass and energy of ion sin the mass spectrometer). For example, a desired mass range of ions may be selected.

A particularly convenient filter may be implemented for a reaction cell that resides on the end of the branch ion path. An ion mirror may be used to reflect product ions back along the branch ion path. The potential on the ion mirror may be set so as to reflect ions below a desired upper energy or mass. A further potential may be set to be encountered by the reflected ions. This potential may be set to define a lower energy or mass, such that only ions above this threshold will continue to the mass analyser where they are detected. Hence, only ions with energies or masses between the upper and lower limits are allowed to pass back to the mass analyser, with all other ions being filtered out.

From a fourth aspect, the present invention resides in a method of mass spectrometry comprising: guiding a first set of ions from an ion source to a mass analyser along a main ion path and obtaining at least one mass spectrum from the first set of ions; and guiding a second set of ions from the ion source along a branch ion path to a reaction cell that is separated from the main ion path, forming product ions in the reaction cell, guiding the product ions along the branch ion path to rejoin the main ion path, guiding the product ions along the main ion path to the mass analyser, and obtaining at least one mass spectrum from the product ions.

Advantageously, this allows the reaction cell to be operated continuously during operation of the mass spectrometer. Put another way, a method is provided for operating a mass spectrometer to collect mass spectra from precursor and product ions, wherein a reaction cell is left in an operational mode such that ions entering the reaction cell are processed to form product ions, and a change from obtaining mass spectra from precursor ions to product ions is effected by switching the ion path between a branch ion path to the reaction cell and a main ion path that bypasses the reaction cell.

Optionally, the above methods may be applied to tandem mass spectrometry where forming product ions comprises fragmenting precursor ions to form fragment ions. Other methods of "reacting" the ions may be employed. Essentially, the reaction cell alters the population of ions within the reaction cell in some way. The ions themselves may change (e.g. by fragmentation or reaction), ions may be added (e.g. calibrants), ions may be removed (e.g. according to mass or ion mobility selection), or properties of the ions may change (e.g. their kinetic or internal energy, etc.).

For analysis of complex mixtures, the mass spectrometer could be used in two steps. In the first step of experiments, no mass selection is performed and all precursor ions and fragments of those precursor ions are measured by the mass analyser. These two mass spectra are compared to identify whether any said product ions correspond to any precursor ions, either by m/z or by difference of m/z. For reliable identification, m/z or difference of m/z should be determined with accuracy better than a) 0.01%; b) 0.002%; c) 0.001%; d) 0.0005%; e) 0.0002%, with increasing mass accuracy reducing chances of false positives.

After precursors of interest are identified, the mass spectrometer could be switched to use a filter to isolate only one or several precursors of interest from a set of ions, and to direct only the isolated ions along the branch ion path to the reaction cell. Fragment spectra for fragment ions so derived from those selected precursors of interest are subsequently acquired after transport to the mass analyser and could be searched against a database.

The method of the present invention may also comprise mass or energy filtering, as already described above.

The invention also resides in a controller operable to cause a mass spectrometer to operate in accordance with any of the methods described above. The invention also resides in a computer program containing computer program instructions that, when executed on the above controller, cause the mass spectrometer to operate in accordance with any of the above methods, as well as residing in a computer readable medium bearing such a computer program.

BRIEF DESCRIPTION OF THE FIGURES

In order that the invention may be more readily understood, exemplary embodiments will now be described with reference to the accompanying drawings in which.

DETAILED DESCRIPTION OF THE EMBODIMENTS

The present invention provides a mass spectrometer having a reaction cell and mass analyser provided on separate ion paths. This arrangement may be realised in several ways, and FIG. 1 shows four of the possible configurations in highly schematic form.

Figure 1A:
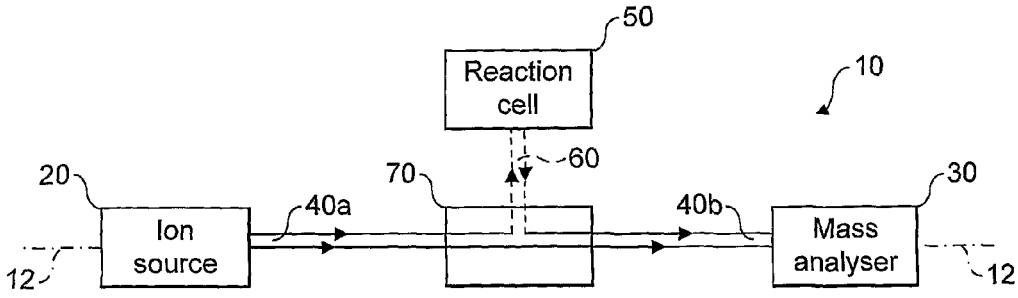
FIGS. 1*a-d* are schematic representations of alternative arrangements of mass spectrometers in accordance with embodiments of the present invention.

FIG. 1*a* shows an arrangement of a mass spectrometer 10 comprising an ion source 20, a mass analyser 30 located on a main ion path 40 and a reaction cell 50 located on a branch ion path 60. In FIGS. 1*a* to 1*d*, the main ion path is shown as the solid line 40, while the branch ion path is show as the broken line 60. The mass spectrometer 10 has a longitudinal axis 12 that coincides with the main ion path 40 extending from the ion source 20 to the mass analyser 30. The main ion path 40 has a first leg 40*a* that extends from the ion source 20 to a junction 70 formed by ion optics. A second leg 40*b* of the main ion path 40 continues from the junction 70 to the mass analyser 30. The branch ion path 60 extends from the junction 70 to the reaction cell 50. Although the branch ion path 60 is shown at right angles to the longitudinal axis 12, other angles may be chosen. The ion optics 70 are operable to guide ions selectively along one of the following three routes: (i) from the first leg 40*a* to the second leg 40*b* of the main ion path 40; (ii) from the first leg 40*a* of the main ion path 40 to the branch ion path 60, and (iii) from the branch ion path 60 to the second leg 40*b* of the main ion path 40.

In operation, the mass spectrometer 10 may be operated to collect mass spectra from either precursor ions or product ions. When collecting spectra from the precursor ions, the ion source 20 generates precursor ions that are guided to the junction 70 where the ion optics then guide the precursor ions directly along the second leg 40*b* of the main ion path 40 to the mass analyser 30 where mass spectra are collected. When collecting mass spectra from product ions, precursor ions generated by the ion source 20 are deflected by the ion optics at junction 70 to travel along the branch ion path 60 to the reaction cell 50. Product ions are produced in the reaction cell 50 from the precursor ions. The product ions return along the branch ion path 60 to the junction 70 where the ion optics deflect the product ions to follow the second leg 40*b* of the main ion path 40 to the mass analyser 30 where mass spectra of the product ions are collected. In all Figures, additional stage(s) of mass analysis could be installed between ion source 20 and junction 70, including those of ion trapping, quadrupole and time-of-flight type.

Figure 1B:
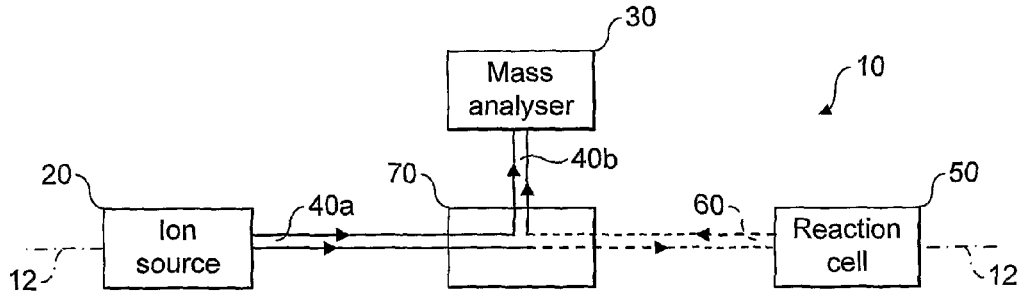

FIG. 1*b* shows an alternative arrangement that is broadly similar to FIG. 1*a*, except that the mass analyser 30 and the reaction cell 50 have been transposed. Consequently, the first leg 40*a* of the main ion path 40 and the branch ion path 60 lie along the longitudinal axis 12. During collection of mass spectra from precursor ions, the precursor ions produced by the ion source 20 are guided to the junction 70 where the ion optics deflect the ions to continue along the second leg 40*b* of the main ion path 40 to the mass analyser 30. Although shown to be deflected through a right angle, other angles may be chosen. During collection of mass spectra from product ions, precursor ions are merely guided through the junction 70 to continue along the branch ion path 60 to the reaction cell 50. After the product ions are formed, they return to the junction 70 where they are deflected by the ion optics to travel to the mass analyser 30 along the second leg 40*b* of the main ion path 40.

Preferably, in both FIGS. 1*a* and 1*b*, the ion optics at the junction 70 is operated to pulse ions into the mass analyser 30.

The mass spectrometers 10 of FIGS. 1*a* and 1*b* both have longitudinal axes 12 with either the mass analyser 30 or the reaction cell 50 positioned thereon. Alternative arrangements forsake the longitudinal axis 12. For example, the ion optics at junction 70 may deflect ions orthogonally to both the mass analyser 30 and the reaction cell 50 so that, for example, a T-shaped mass spectrometer results. Also, deflection may be through less than a right angle so that a Y-shaped mass spectrometer results.

Figure 1C:
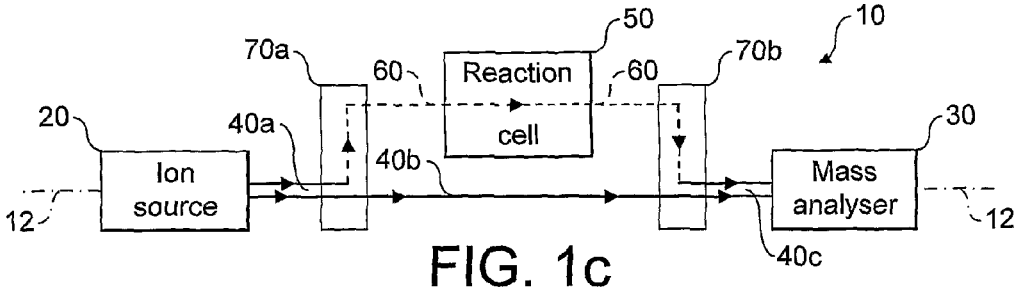
Figure 1D:
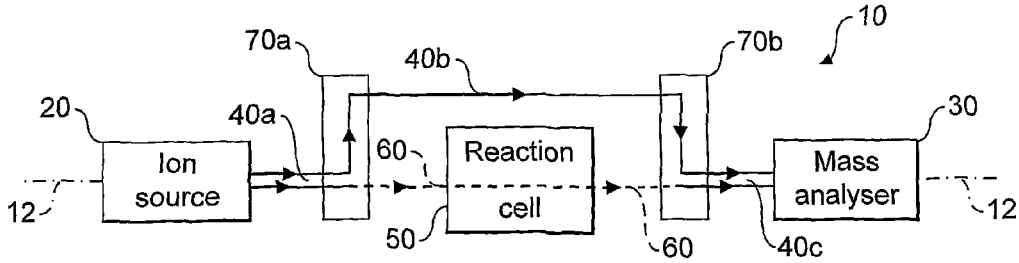

In the embodiments of FIGS. 1*a* and 1*b*, the product ions must exit the reaction cell 50 in the opposite direction to which precursor ions entered the reaction cell 50. FIGS. 1*c* and 1*d* show mass spectrometers 10 where the product ions exit the reaction cell 50 in the same direction as the precursor ions entered the reaction cell 50.

FIG. 1*c* shows a mass spectrometer 10 having a main ion path 40 that corresponds to its longitudinal axis 12. A branch ion path 60, upon which the reaction cell 50 is located, divides from the main ion path 40 at a first junction 70*a* and rejoins the main ion path 40 at a second junction 70*b*. Consequently, the main ion path 40 comprises three sections: (i) a first leg 40*a* extending from the ion source 20 to the first junction 70*a* and common to all ions passing through the mass spectrometer 10; (ii) a second leg 40*b* that extends between the first and second junctions 70*a* and 70*b*, and so runs in parallel to the branch ion path 60; and (iii) a third leg 40*c* that extends from the second junction 70*b* to the mass analyser 30 that is common to all ions passing through the mass spectrometer 10.

When obtaining mass spectra from precursor ions, ions generated in the ion source 20 are guided along the first leg 40*a* of the main ion path 40 to the first junction 70*a* where ion optics merely guide the ions to continue in much the same direction along the second leg 40*b* of the main ion path 40. The precursor ions then arrive at the second junction 70*b* where ion optics again merely guide the ions along their path to the mass analyser 30 via the third leg 40*c* of the main ion path 40. Preferably, ion optics at the second junction 70*b* is operated to pulse ions into the mass analyser 30.

When collecting mass spectra from product ions, precursor ions produced by the ion source 20 arrive at the first junction 70*a* where the ion optics divert the ions to the reaction cell 50 along branch ion path 60. Here, product ions are formed from the precursor ions. In the embodiments of FIGS. 1*a* and 1*b*, either the ions must be trapped in the reaction cell 50 and ejected backwards or they must be reflected. In the embodiment of FIG. 1*c*, while ions may be trapped if desired, ions may merely be allowed to drift through the reaction cell 50, reacting as they go. The product ions exiting the reaction cell 50 arrive at the second junction 70*b* where the ion optics divert their paths such that they rejoin the main ion path 40 to continue to the mass analyser 30.

The mass spectrometer 10 of FIG. 1*d* is broadly similar except that the second leg 40*b* of the main ion path 40 and the branch ion path 60 have been transposed. Consequently, the reaction cell 50 lies on the longitudinal axis 12 of the mass spectrometer 10. When mass spectra are to be collected from precursor ions, ions generated by the ion source 20 are diverted by the ion optics at the first junction 70*a* to follow the second leg 40*b* of the main ion path 40 that extends around the reaction cell 50. The precursor ions are then diverted back onto the main ion path 40 to follow the third leg 40*c* to the mass analyser 30. When mass spectra are to be taken from product ions, the ion optics at the first junction 70*a* merely guide the precursor ions to continue along the longitudinal axis 12, thereby following the branch ion path 60 to the reaction cell 50 where they react to form the product ions. The product ions continue along the branch ion path 60 to the second junction 70*b* where they are merely guided to follow the longitudinal axis 12 to the mass analyser 30.

Of course, other configurations are possible akin to those of FIGS. 1*c* and 1*d*. For example, the mass analyser 30 may not be positioned on the longitudinal axis 12, but may be positioned off-axis to align with the reaction cell 50. This would mean that whatever ion path the ions followed, they would only be deflected at one junction 70, either at junction 70*a* then to continue straight through the reaction cell 50 and junction 70*b*, or vice versa. Both the reaction cell 50 and the mass analyser 30 may be offset from the longitudinal axis 12. For example, they may be offset to either side of the longitudinal axis 12, such as by equal amounts.

As will be appreciated, separate ion paths are provided to the mass analyser 10, one via the reaction cell 50 and one bypassing the reaction cell 50. In this way, the reaction cell 50 may be left in an operative state at all times: if a precursor ion scan is required, the ions may simply bypass the reaction cell 50 and so remain intact. If a product ion scan is required, the ion optics 70 may be switched rapidly to divert precursor ions to the reaction cell 50.

Figure 2:
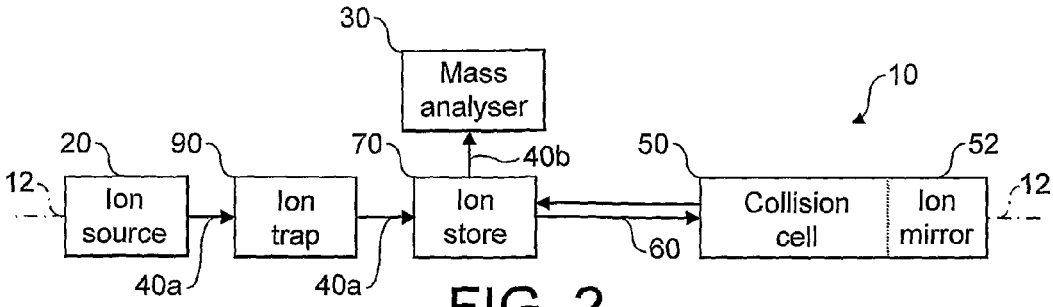
FIG. 2 is a schematic representation of a mass spectrometer in accordance with an embodiment of the present invention.

The arrangements of FIGS. 1*a* to 1*d* are highly schematic and show only the basic elements that are most relevant to the present invention. Typically, any particular embodiment of a mass spectrometer according to the present invention will comprise other parts to allow further functionality, such as ion traps, ion stores and further ion optics for guiding ions through the mass spectrometer 10 or even for ion selection. An exemplary embodiment of a tandem mass spectrometer 10 according to the present invention is shown schematically in FIG. 2 and in further detail in FIG. 4. The tandem mass spectrometer 10 is used to collect mass spectra from precursor and fragment ions.

Figure 4:
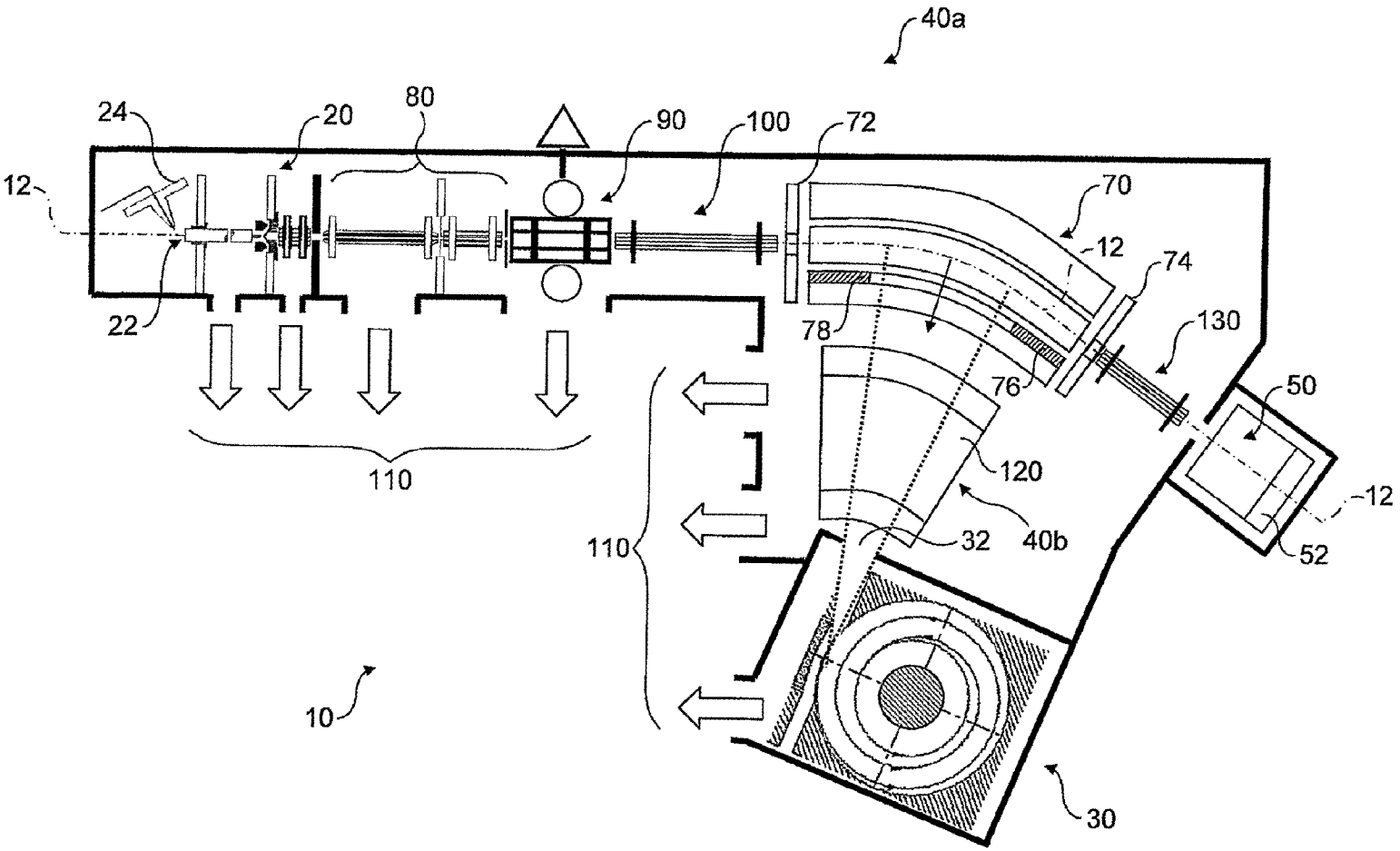
FIG. 4 is a more detailed representation of a mass spectrometer in accordance with the general arrangement of FIG. 2.

The mass spectrometer 10 corresponds to that of FIG. 1*b* in that it has a longitudinal axis 12 that extends from an ion source 20 to a reaction cell 50. The ion source 20 may be of any conventional type. FIG. 4 shows that the ion source 20 is supplied with analyte ions 22 to be ionised by an ioniser 24.

Ions leaving the ion source 20 are guided along the longitudinal axis 12 of the mass spectrometer 10 by ion optics 80 to enter a linear ion trap 90. Ions are accumulated temporarily in the ion trap 90 according to e.g. US 2003/0183759 or U.S. Pat. No. 6,177,668. In this embodiment, the ion trap 90 contains 1 mTorr of helium such that the ions lose some of their kinetic energy in collisions with the gas molecules. Ions are ejected from the ion trap 90, either after a fixed time delay (chosen to allow sufficient ions to accumulate in the ion trap 90) or after sufficient ions have been detected in the ion trap 90. To effect the latter, the ion trap 90 may be provided with mass-analysing and detecting capabilities that may be used to obtain prescans of the ions stored in the ion trap 90.

Ions ejected from the ion trap 90 are guided by ion optics 100 to an intermediate ion store 70. The intermediate ion store 70 comprises a curved quadrupolar linear trap 70 such that the longitudinal axis 12 bends as it extends therethrough. The intermediate ion store 70 is bounded at its ends by respective gate electrodes 72 and 74 that are used to trap and eject ions. Cooling gas is introduced into the intermediate ion store 70 such that ions are trapped through gas-assisted cooling. Nitrogen, argon, helium or any other suitable gaseous substance could be used as a cooling gas, although nitrogen is preferred. Typically, <1 mTorr of nitrogen is used in the intermediate ion store 70. The pumping arrangement used, indicated by the pumping ports and arrows 110, ensures that other components are substantially free of gas and kept at the required high vacuum.

Ions are accumulated in the intermediate ion store 70, either from a single injection or from multiple injections from the ion trap 90 to accumulate a larger ion population. Ion accumulation may be performed using automatic gain control, as is well known in the art.

The intermediate ion store 70 corresponds to the junction 70 of FIG. 1*b*, the ion path from the ion source 20 to the intermediate ion store 70 forming the first leg 40*a* of the main ion path 40. Thus, ions accumulated in the intermediate ion store 70 are ejected either axially along the branch ion path 60 or orthogonally along the second leg 40*b* of the main ion path 40. The curved intermediate ion store 70 is advantageous as it may be used to provide pulsed ion beams for orthogonal ejection to the mass analyser 30. Thus, ions may be ejected directly to the mass analyser 30 in tight bunches (i.e. very quickly) without requiring further shaping.

For collection of mass spectra from precursor ions, the intermediate ion store 70 ejects the ions orthogonally through an aperture 76 provided in an electrode 78 of the intermediate ion store 70 to a high-resolution mass analyser 30. In this embodiment, an electrostatic mass analyser 30 of the Orbitrap type is employed. The curvature of the intermediate ion store 70 ensures that ions ejected therefrom are focused through ion optics 120 towards the entrance 32 of the mass analyser 30. Furthermore, ions trapped in the intermediate ion store 70 may be subjected to potentials placed on the gates 72 and 74 to cause the ions to bunch in the centre of the intermediate ion store 70 which also assists focusing. Once in the mass analyser 30, mass spectra may be collected from the precursor ions in the usual fashion.

When mass spectra are to be collected from product ions, the intermediate ion store 70 operates to eject ions to the reaction cell 50 via ion optics 130. In this embodiment, the mass spectrometer 10 is a tandem mass spectrometer such that the reaction cell comprises a gas-filled collision cell 50 for fragmenting ions through CID. Although the collision cell 50 may be operated in trapping mode, this embodiment employs a transmission mode. The collision cell 50 is terminated by an ion mirror 52 that carries a large potential to reflect ions. Thus precursor ions enter the collision cell 50 where they may fragment. Ions enter the ion mirror 52, where fragment ions are reflected and precursor ions may be allowed to pass (as described in further detail below). The fragment ions then traverse the collision cell 50 in the reverse direction, where they may fragment further. The fragment ions exit the collision cell 50 and are guided by the ion optics 130 to enter the intermediate ion store 70 for a second time, where the fragment ions are trapped. As the precursor ions are ejected from the intermediate ion store 70 as a pulse, the fragment ions tend to arrive back at the intermediate ion store 70 also as a pulse. Once trapped, the fragment ions are ejected directly to the mass analyser 30 as a pulse (i.e. very quickly) without further shaping being necessary. Spectra are then collected by the mass analyser 30, as already described with respect to the precursor ions.

Moreover, the ion trap 90 or the intermediate ion store 70 may be used for preliminary mass selection. Preliminary mass selection allows a wide mass range of precursor ions to be split into several smaller sub-ranges (with a mass range of typically 20-50%), so that a loss of a certain moiety such as a phosphate group does not result in a great spread of mass (and thus energy) of the remaining fragments. If the ion trap 90 is used for preliminary mass selection, the intermediate ion store 70 may be used to accumulate ions over successive fills from the ion trap 90, each fill corresponding to a smaller sub-range of masses. All precursor ions within a sub-range could be fragmented and analysed in parallel.

Figure 3:
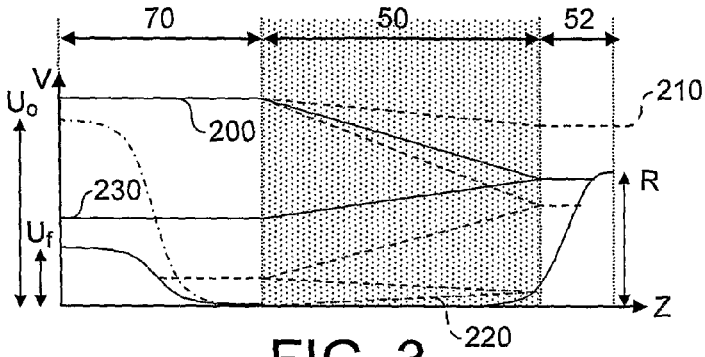
FIG. 3 is a graphical representation of the potentials set on an intermediate ion store, reaction cell and ion mirror of the mass spectrometer of FIG. 2.

To reduce the complexity of the fragment spectra when a whole sub-range is fragmented, the collision cell 70 may be operated as a crude mass filter through energy selection. This works because fragment ions have approximately the same velocity as their precursor, and so their energy is proportional to their mass. Such embodiments with crude mass selection are especially suited for parallel analysis of fragments from multiple precursors as they reduce complexity of the spectra. Mass selection in the collision cell 50 allows rejection of unwanted ions (e.g. unreacted precursor ions) and/or selection of small mass ranges (e.g. the division of a mass range of likely fragments into small sub-ranges, allowing optimised collection of mass spectra from each sub-range). This may be achieved by applying appropriate potentials on the mass spectrometer 10, of which one possible arrangement is shown in FIG. 3.

A high energy filter is provided by ion mirror 52 where a potential R is applied to provide an upper threshold. As shown in FIG. 3, a pulse of precursor ions are ejected from the intermediate ion store 70 and accelerated by a potential $U_o$ placed on the gate 74, typically 100-300 V, as shown at 200. The precursor ions lose energy as they fragment in the collision cell 50 by virtue of their lower mass. The potential R is chosen to reflect fragment ions below the desired threshold energy, with any remaining precursor ions and unwanted high-energy (and hence high-mass) fragment ions continuing beyond the mirror 270 as shown at 210 to be lost or, alternatively, collected in a separate ion store (not shown).

A low energy filter is provided by placing a potential $U_f$ at a convenient point before the intermediate ion store 70. In this embodiment, the potential is placed on the gate 74, i.e. the potential $U_o$ is lowered to $U_f$ after the pulse of precursor ions have left the intermediate ion store 70. $U_f$ is chosen such that fragment ions having an energy (and hence mass) lower than a desired threshold are reflected to become trapped in the reaction cell 70 as indicated at 220. Ions with an energy above the threshold are able to pass back into the intermediate ion store 70 as indicated at 230, from where they are guided to the mass analyser 30.

As a result, the reaction cell 50 acts as an energy analyser such that ions only pass to the mass analyser 30 if their energy ($\frac{1}{2}mv^2$) falls within the range $zeU_f < \frac{1}{2}mv^2 < zeR$. $U_f$ and R may be chosen to select a desired range of fragment ion masses. This mass selection reduces the number of candidate peaks within mass spectra and so provides improved dynamic range and fewer false identifications. It also allows comparison of spectra for precursors and fragments separated in mass exactly according to neutral loss.

Figure 5:
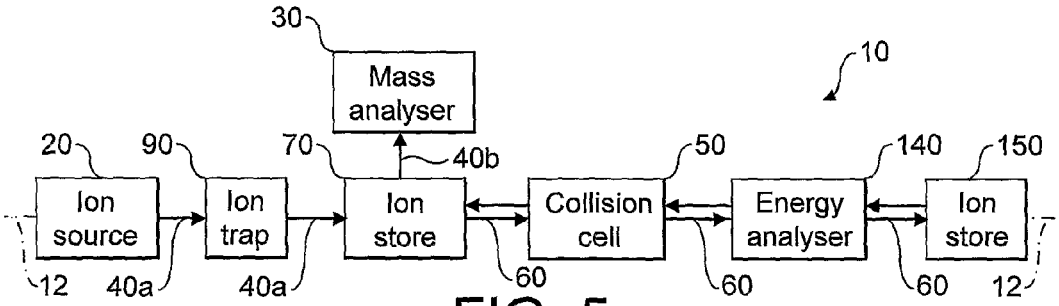
FIG. 5 is a schematic representation of a mass spectrometer in accordance with a further embodiment of the present invention.

FIG. 5 shows in schematic form a further embodiment of a tandem mass spectrometer 10 according to the present invention. The mass spectrometer 10 has the arrangement of FIG. 1*b* and is broadly similar to the mass spectrometer 10 of FIG. 2 in that they share a common main ion path 40. Hence, this part will not be described again.

Turning to the branch ion path 60, the collision cell 50 follows the ion store 70. The collision cell 50 is not terminated by an ion mirror 52 but instead comprises a gate electrode (not shown) that includes an aperture to allow ions to continue along the longitudinal axis 12 to an energy analyser 140. Operating in transmission mode, the pulse of precursor ions ejected axially from the ion store 70 fragment in the collision cell 50, and the fragment ions continue to travel along the branch ion path 60 to the energy analyser 140. The energy analyser 140 operates such that only fragment ions within a desired range of energies (and hence masses) exit therefrom to continue their passage along the branch ion path 60. As the required energy resolution is quite low, almost any known energy analyser 140 may be used, e.g. cylindrical, spherical, flat plate, etc. Selected fragment ions are trapped in a further ion store 150 provided downstream of the energy analyser 140. The further ion store 150 may be gas-filled to assist in trapping.

Figure 6:
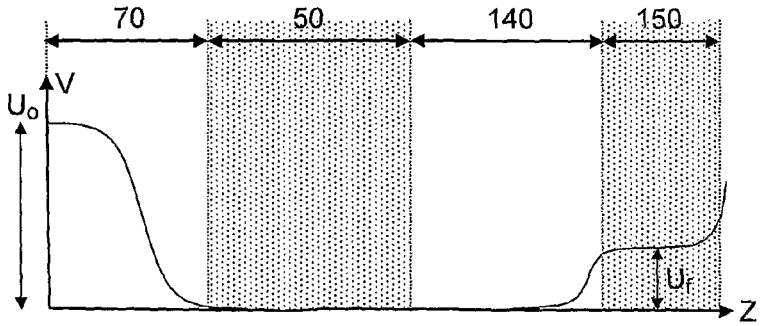
FIG. 6 is a graphical representation of the potentials set on an intermediate ion store, reaction cell, energy analyser and further ion store of the mass spectrometer of FIG. 5.

FIG. 6 shows the potentials placed on the intermediate ion store 70, the collision cell 50, the energy analyser 140 and the further ion store 150. Ions are accelerated from the intermediate ion store 70 by a potential $U_0$. The further ion store 150 is floated at a voltage $U_f$ that is usually less than $U_0$. Storage in the further ion store 150 is preferably achieved using gas-cooling and RF fields. Thus, the further ion store 150 may comprise an RF-only multipole or a set of RF-only apertures. After ion capture in the further ion store 150, the potentials on the collision cell 50 and the further ion store 150 are raised to $U_o$ and the energy analyser 140 is also adjusted to transmit ions of this energy, such that fragment ions pass back to the ion store 70 for subsequent injection into the high-resolution mass analyser 30.

Further fragmentation on the way back does not take place as ion energy in the collision cell 50 will be too low due to the new setting of potential $U_o$ on the collision cell 50. As a result, gas need not be evacuated from the collision cell 50 prior to the ions' return.

It will be evident to the skilled person that variations may be made to the above embodiments without departing from the scope of the present invention.

For example, the ion source 20 may be freely chosen from the following non-exhaustive list of possibilities: electrospray source, atmospheric pressure photoionisation source or chemical ionisation source, atmospheric pressure/reduced pressure/vacuum MALDI source, electron impact (EI) source, chemical ionisation (CI) source, secondary ion source, or any preceding stage of mass analysis or ion selection (e.g. DC or field-asymmetric ion mobility spectrometer, travelling wave spectrometer, etc.) would all be suitable choices.

The ion trap 90 may also be chosen from a number of conventional types, in accordance with the experiments to be performed. Options include storage RF multipole with resonant or mass-selective ion selection, 3D quadrupole ion trap, or linear trap with radial or axial ejection. Whilst the above embodiments describe using the ion trap 90 in a trapping mode, it may alternatively be used in transmission mode. For example, potentials mat be placed on the ion trap 90 merely to guide ions therethrough. Options include transporting elongated electrodes, magnetic sector or Wien filter, quadrupole mass filter, etc.

Again, the intermediate ion store 70 can be chosen from ion traps and ion stores such as 3D quadrupole ion traps, storage RF multipoles without RF switching, storage multipoles according to U.S. Pat. No. 5,763,878 or US 2002/0092980, or storage RF quadrupole with RF switching according to GB 0413852.5.

The intermediate ion store 70 may be operated either in a transmission mode or in a trapping mode, for either ions arriving from upstream or for ions returning from downstream. There is no requirement that the same type of trapping be used for both upstream and downstream arrivals.

The trapping mode may be used in conjunction with multiple fills of ions from the ion trap 90. This may include fills of different types of ions, as described in our co-pending British patent application.

In transmission mode, ions are merely guided to the appropriate exit aperture as they drift through the intermediate ion store 70. For collection of mass spectra from precursor ions, the ions are merely guided axially or deflected orthogonally to the mass analyser 30 such that the precursor ions bypass the reaction cell 50. Hence, the reaction cell 50 may be left in an operative state at all times the mass spectrometer 30 is in operation as this will not have any effect on the precursor ions. A variation to the transmission mode of operation is to allow multiple ion bounces between the ion trap 90 and the reaction cell 50, before switching to the capture mode after a predetermined number of bounces. Each bounce could involve a different type of processing in ion trap 90, intermediate ion store 70 or reaction cell 50.

Although an electrostatic mass analyser 30 is mentioned above, an Orbitrap type being particularly preferred, other types may be employed. For example, a Fourier transform ion cyclotron resonance (FT-ICR) cell, a single- or multiple-reflection time of flight (TOF) mass spectrometer would also be suitable.

The reaction cell 50 may be operated to capture ions prior to reacting or ions may be allowed to react as they drift through in a transmission mode. When operating the mass spectrometer 10 of FIGS. 2 and 4 in a trapping mode, the large potential on the ion mirror 52 may be used in combination with a potential on the intermediate ion store 70 in order to trap fragment ions (although the latter potential could also be applied at the entrance to the reaction cell 50).

The reaction cell 50 may take one of many forms that effectively operate on the population of ions within the reaction cell 50 to change that population in some way. The ions themselves may change (e.g. by fragmentation or reaction), ions may be added (e.g. calibrants), ions may be removed (e.g. according to mass selection), or properties of the ions may change (e.g. their kinetic or internal energy, etc.). Thus, the reaction cell 50 may be any one of a number of possibilities to meet these functions, in addition to the gas-filled collision cell described above that is used for collision-induced dissociation. For example the reaction cell 50 may be: a cell provided with an ion source for the introduction of further ions (including ions of opposite polarity), a cell provided with a laser source for photon-induced association, a cell provided with a surface for surface-inducted dissociation, a cell provided with an electron source for electron-capture dissociation, or a DC or field-asymmetric ion mobility spectrometer to act as an ion instability or charge filter.

Of course, the method of operating the mass spectrometer described above may be implemented using a controller. The controller may take a hardware or software form. For example, the controller may take the form of a suitably programmed computer, having a computer program stored therein that may be executed to cause the mass spectrometer to operate as described above.

The invention claimed is:

1. A mass spectrometer comprising: an ion source, a reaction cell and a mass analyser; the mass spectrometer defining a main ion path and a branch ion path, wherein the main ion path extends between the ion source and the mass analyser, and the main ion path meets the branch ion path at a junction comprising ion optics operable to guide selectively ions travelling downstream from the ion source along either the main ion path or the branch ion path, the branch ion path rejoining the main ion path upstream of the mass analyser either at the junction or at a further junction comprising further ion optics operable to guide ions towards the mass analyser that are incident from both the main ion path and the branch ion path, wherein the reaction cell is positioned on a separated portion of the branch ion path and wherein the ion optics immediately upstream of the mass analyser are operable to guide pulses of ions along the main ion path to the mass analyser.

2. The mass spectrometer of claim 1 wherein:

the ion source and an entrance aperture to the reaction cell define a longitudinal axis along which ions may travel; and the junction includes ion optics switchable between a first mode in which ions from the ion source are guided along the longitudinal axis to the reaction cell and product ions produced in the reaction cell are guided to the mass analyser for analysis, and a second mode in which ions from the ion source are deflected from the longitudinal axis and guided to the mass analyser for analysis without entering the reaction cell.

3. The mass spectrometer of claim 1, wherein:

the ion source and an entrance aperture to the mass analyzer define a longitudinal axis along which ions may travel; and the junction includes ion optics switchable between a first mode in which ions from the ion source are deflected from the longitudinal axis and guided to the reaction cell and product ions produced in the reaction cell are guided back to the longitudinal axis and to the entrance aperture of the mass analyser, and a second mode in which ions from the ion source are guided along the longitudinal axis to the mass analyser for analysis without entering the reaction cell.

4. The mass spectrometer of claim 1, further configured to provide the ions to the mass analyser as a pulse of ions.

5. The mass spectrometer of claim 1 wherein the mass analyser is one of an FT ICR, a time-of-flight or an electrostatic mass analyser.

6. The mass spectrometer of claim 1, further comprising an ion trap located at least one of the junction and the further junction, the ion trap comprising electrodes operable with RF-only potentials and an inlet arranged for allowing gas to be introduced into the ion trap.

7. The mass spectrometer of claim 6, wherein the ion trap is a curved linear trap operable to eject ions both axially and off-axis.

8. The mass spectrometer of claim 1, wherein the reaction cell is operable as a fragmentation cell.

9. The mass spectrometer of claim 1, further comprising an ion trap located upstream in the ion path of the junction.

10. The mass spectrometer of claim 1, further comprising a mass analyser located upstream in the ion path of the junction.

11. The mass spectrometer of claim 1, further comprising a controller operable to control operation of the mass spectrometer.

12. The mass spectrometer of claim 1, further comprising a mass filter located upstream in the ion path of the reaction cell, and a controller operable to use the mass filter to select ions for guiding to the reaction cell.

13. The mass spectrometer of claim 1, further comprising a filter operable to filter product ions produced by the reaction cell.

14. A method of mass spectrometry comprising:

guiding a first set of ions from an ion source to a mass analyser along a main ion path and obtaining at least one mass spectrum from the first set of ions; and guiding a second set of ions from the ion source along a branch ion path to a reaction cell that is separated from the main ion path, forming product ions in the reaction cell, guiding the product ions along the branch ion path to rejoin the main ion path, guiding the product ions along the main ion path to the mass analyser, and obtaining at least one mass spectrum from the product ions;

wherein ions arrive at the mass analyser as pulses of ions.

15. The method of claim 14, wherein the method is performed in a mass spectrometer comprising ion optics located where the branch ion path rejoins the main ion path, and the method further comprises operating the ion optics to eject pulses of ions to the mass analyser.

16. The method of claim 14, wherein forming products in the reaction cell from the second set of ions is performed concurrently with obtaining at least one mass spectrum from the first set of ions.

17. The method of claim 16, comprising guiding the first and second sets of ions from the ion source together and dividing the ions into the first and second sets such that the first set of ions are guided to the mass analyser and the second set of ions are guided to the reaction cell.

18. The method of claim 14 further comprising comparing mass spectra of the first set of ions and product ions to identify whether any said product ions correspond to any precursor ions, either by m/z or by difference of m/z.

19. The method of claim 18, comprising using a database to assist the identification, and wherein m/z or difference of m/z is determined with an accuracy better than one of a) 0.01%; b) 0.002%; c) 0.001%; d) 0.0005%; or e) 0.0002%.

20. The method of claim 14, comprising fragmenting ions in the reaction cell and analysing fragment ions.

21. The method of claim 14, comprising trapping the ions in the reaction cell.

22. The method of claim 14, comprising filtering ions to select ions having masses or energies that fall within a predetermined range, guiding the selected ions to the reaction cell, fragmenting the selected ions, and collecting a mass spectrum from the fragmented ions.

23. The method of claim 22, comprising repeated steps of selecting ions and fragmenting the selected ions, wherein the fragment ions are successively accumulated in an ion store prior to the fragment ions being guided to the mass analyser for collection of a mass spectrum.

24. The method of claim 14, further comprising filtering product ions according to mass or energy.

25. The method of claim 14, further comprising a step of repeatedly filling an ion store with ions prior to guiding the accumulated ions to the mass analyzer.

26. The method of claim 25, wherein the step of repeatedly filling the ion store includes a first step of filling the ion store with a first group of ions and a second step of filling the ion store with a second group of ions while retaining the first group of ions in the ion store, the first and second groups of ions having substantially different mass-to-charge ratios.

27. A computer readable medium having instructions encoded thereon for causing a mass spectrometer to perform the steps of:

guiding a first set of ions from an ion source to a mass analyser along a main ion path and obtaining at least one mass spectrum from the first set of ions; and guiding a second set of ions from the ion source along a branch ion path to a reaction cell that is separated from the main ion path, forming product ions in the reaction cell, guiding the product ions along the branch ion path to rejoin the main ion path, guiding the product ions along the main ion path to the mass analyser, and obtaining at least one mass spectrum from the product ions;

wherein ions arrive at the mass analyser as pulses of ions.

* * * * *